US008104579B1

(12) United States Patent
Fu

(10) Patent No.: US 8,104,579 B1
(45) Date of Patent: Jan. 31, 2012

(54) DETACHABLE SCAFFOLD THAT IS ASSEMBLED EASILY AND QUICKLY WITHOUT NEEDING AID OF A HAND TOOL

(76) Inventor: Yang-Li Fu, Keelung (TW)

( * ) Notice: Subject to any disclaimer, the term of this patent is extended or adjusted under 35 U.S.C. 154(b) by 939 days.

(21) Appl. No.: 12/115,682

(22) Filed: May 6, 2008

(51) Int. Cl.
*E04G 1/00* (2006.01)

(52) U.S. Cl. ..... 182/186.8; 403/49

(58) Field of Classification Search ..... 182/186.7, 182/186.4, 186.8; 403/49; 248/222.12, 222.51, 248/222.52; 411/522, 530, 359, 347
See application file for complete search history.

(56) References Cited

U.S. PATENT DOCUMENTS 990,846 A * 5/1911 Crandall ..... 299/40.1
3,874,802 A * 4/1975 Lindsey ..... 403/49
4,205,586 A * 6/1980 MacNeill ..... 411/530
6,296,077 B1 * 10/2001 Wood et al. ..... 182/186.8
6,554,526 B1 * 4/2003 Egelandsdal ..... 403/294
2007/0187179 A1 * 8/2007 Simoes ..... 182/186.7

FOREIGN PATENT DOCUMENTS

GB 2061445 A * 5/1981

* cited by examiner

*Primary Examiner* — Alvin Chin Shue
(74) *Attorney, Agent, or Firm* — Alan Kamrath; Kamrath IP Lawfirm, PA

(57) ABSTRACT

A scaffold includes a plurality of upright posts, a plurality of transverse posts, a plurality of locking units, a plurality of oblique posts and a plurality of fasteners. Thus, the upright posts, the locking units, the transverse posts, the oblique posts and the fasteners are detachable from each other so that the scaffold is detachable before assembly, thereby facilitating packaging, storage and transportation of the scaffold. In addition, the upright posts, the locking units, the transverse posts, the oblique posts and the fasteners are combined together by a worker himself so that the scaffold is assembled easily and quickly without needing aid of any hand tool, thereby greatly facilitating the worker mounting the scaffold.

15 Claims, 8 Drawing Sheets

DETACHABLE SCAFFOLD THAT IS ASSEMBLED EASILY AND QUICKLY WITHOUT NEEDING AID OF A HAND TOOL

BACKGROUND OF THE INVENTION

1. Field of the Invention

The present invention relates to a scaffold and, more particularly, to a scaffold available for a work, such as a building construction and the like.

2. Description of the Related Art

A conventional scaffold comprises a plurality of upright posts and a plurality of transverse posts mounted between and combined with the upright posts by a plurality of fasteners. Thus, the upright posts and the transverse posts are combined together by the fasteners and are expanded upward to construct the scaffold. However, the components of the scaffold cannot be detached easily and quickly, thereby causing inconvenience to the workers in assembly and transportation of the components of the scaffold. In addition, the components of the scaffold are assembled by aid of hand tools, such as wrenches, hammers, screwdrivers and the like, so that the hand tools easily falls down unintentionally, thereby causing danger to the workers.

BRIEF SUMMARY OF THE INVENTION

In accordance with the present invention, there is provided a scaffold, comprising a plurality of upright posts each provided with a plurality of locking units, and a plurality of transverse posts mounted between the upright posts and each detachably locked onto a respective one of the locking units. Each of the locking units includes a plurality of locking blocks. Each of the locking blocks of each of the locking units is provided with two locking holes and a receiving recess located between the two locking holes. Each of the transverse posts has two opposite ends each provided with an insertion head inserted into the receiving recess of a respective one of the locking blocks of the respective locking unit. The insertion head of each of the transverse posts is provided with two opposite snapping portions each detachably snapped into a respective one of the two locking holes of the respective locking block of the respective locking unit to combine the insertion head of each of the transverse posts with the respective locking block of the respective locking unit.

The primary objective of the present invention is to provide a detachable scaffold that is assembled easily and quickly without needing aid of a hand tool.

Another objective of the present invention is to provide a detachable scaffold that is assembled and disassembled easily and quickly.

A further objective of the present invention is to provide a scaffold, wherein the upright posts, the locking units, the transverse posts, the oblique posts and the fasteners are detachable from each other so that the scaffold is detachable before assembly, thereby facilitating packaging, storage and transportation of the scaffold.

A further objective of the present invention is to provide a scaffold, wherein the upright posts, the locking units, the transverse posts, the oblique posts and the fasteners are combined together by a worker himself so that the scaffold is assembled easily and quickly without needing aid of any hand tool, thereby greatly facilitating the worker mounting the scaffold.

A further objective of the present invention is to provide a scaffold, wherein the scaffold is assembled without needing aid of any hand tool, so that the worker needs not to place hand tools on the scaffold and needs not to worry about possibility of falling of the hand tools, thereby protecting the worker's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 4 is a front exploded operational view of the scaffold as shown in

FIG. 3.

Figure 3:
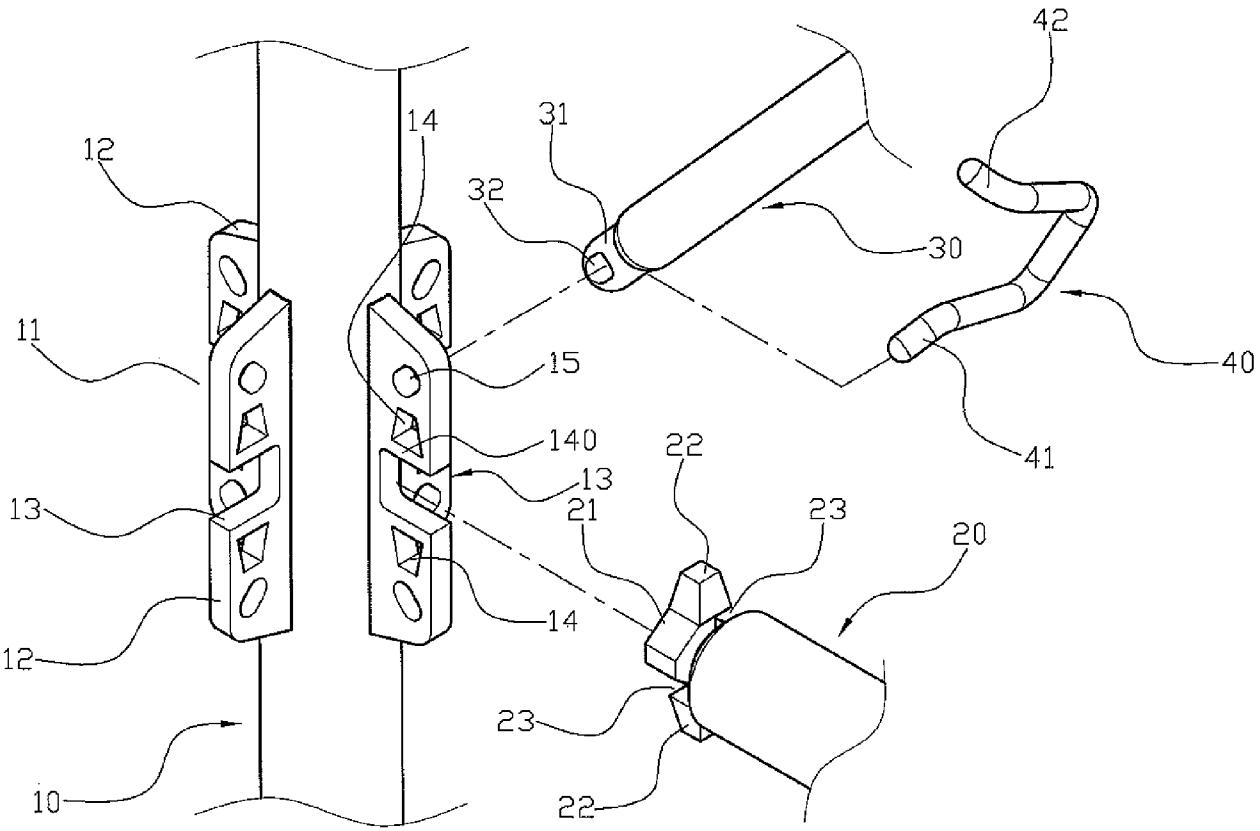
FIG. 3 is an exploded perspective view of the scaffold as shown in FIG. 2.
Figure 5:
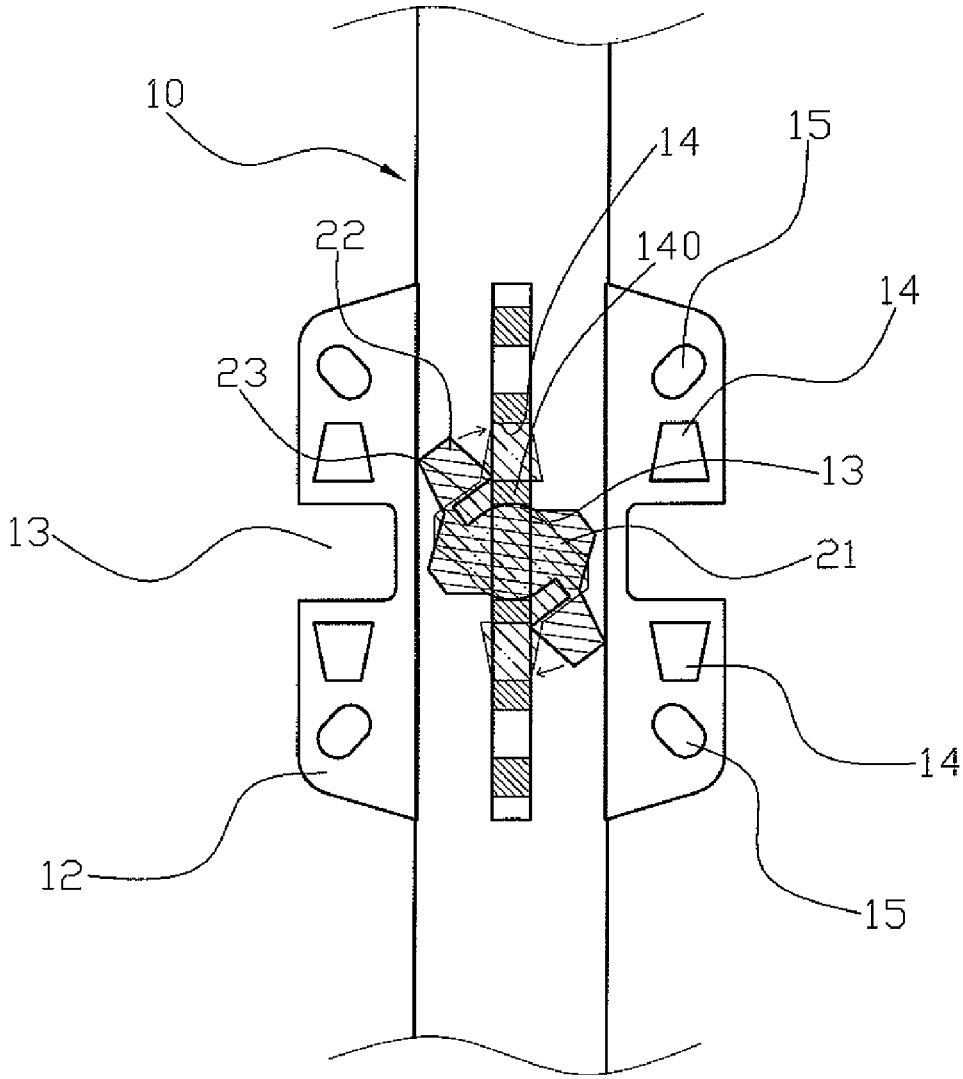

FIG. 5 is a side cross-sectional operational view of the scaffold as shown in FIG. 3.

Figure 6:
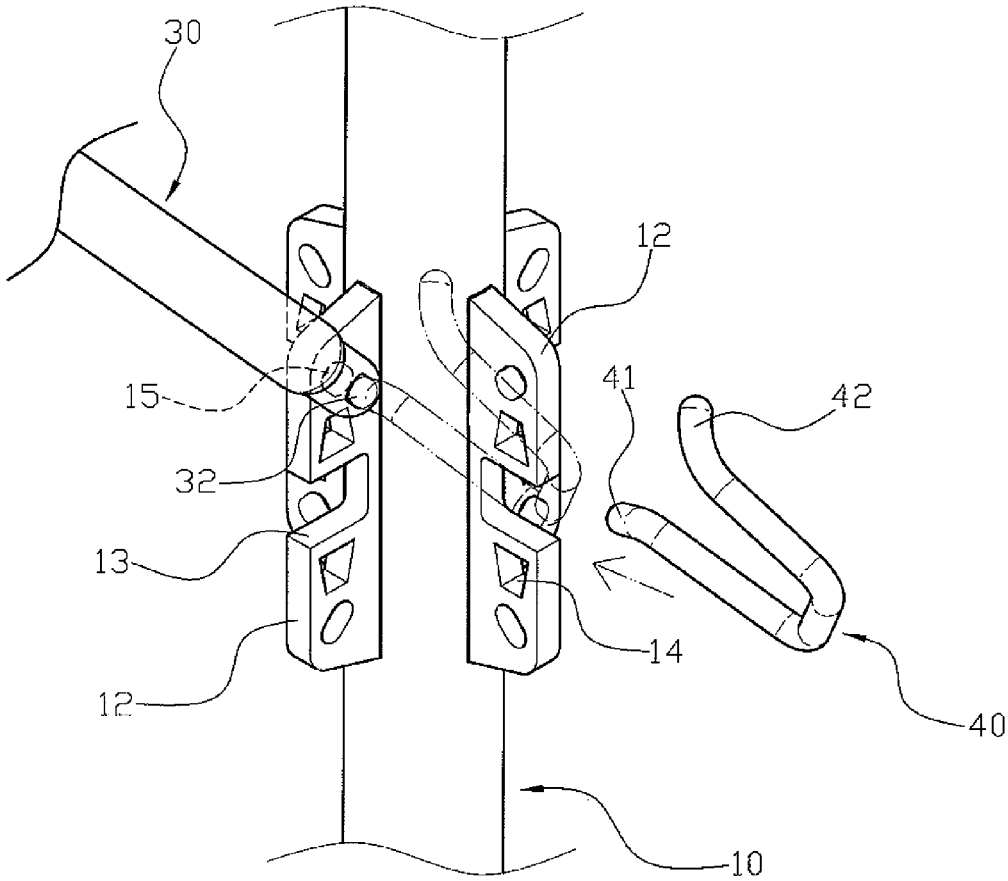

FIG. 6 is an exploded perspective operational view of the scaffold as shown in FIG. 3.

Figure 7:
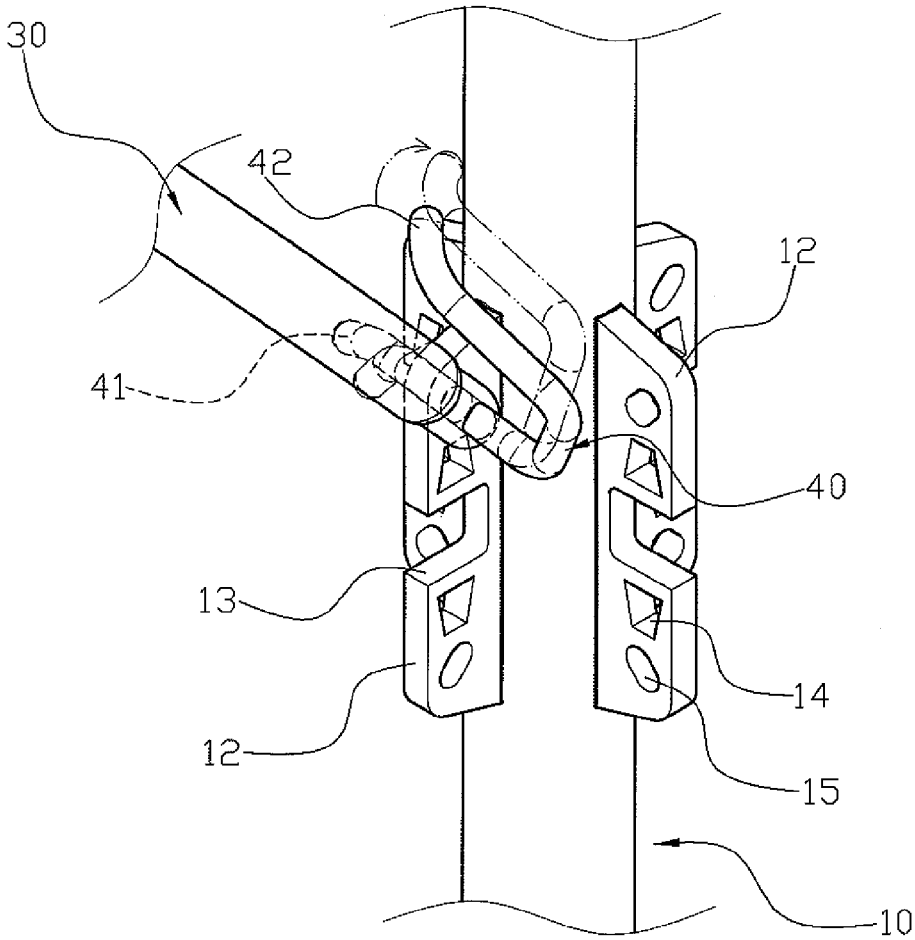

FIG. 7 is an exploded perspective operational view of the scaffold as shown in FIG. 6.

Figure 8:
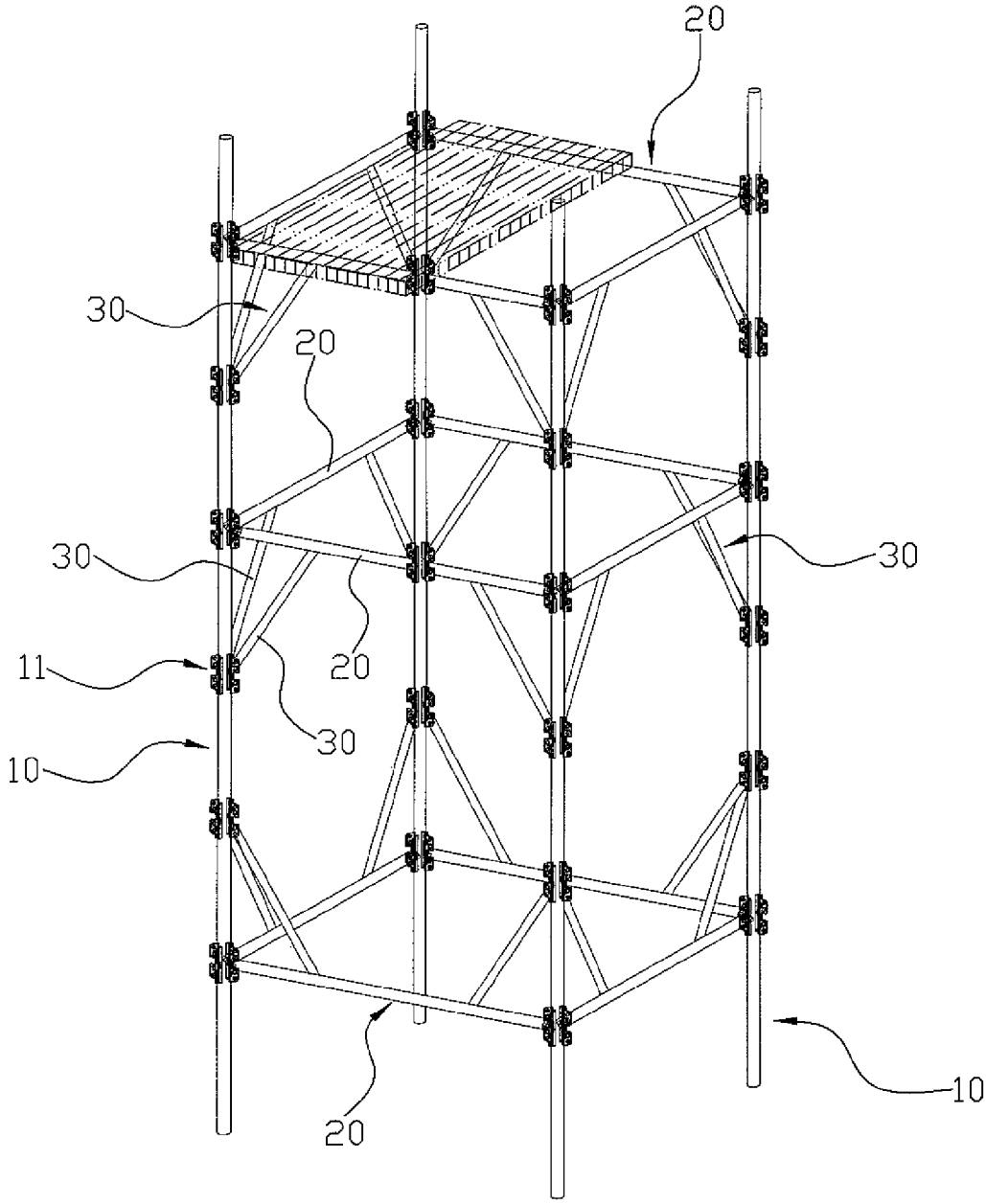

FIG. 8 is a perspective view of a scaffold in accordance with another preferred embodiment of the present invention.

DETAILED DESCRIPTION OF THE INVENTION

Referring to the drawings and initially to FIGS. 1-7, a scaffold in accordance with the preferred embodiment of the present invention comprises a plurality of upright posts 10 each provided with a plurality of locking units 11, and a plurality of transverse posts 20 mounted between the upright posts 10 and each detachably locked onto a respective one of the locking units 11.

The locking units 11 on each of the upright posts 10 are spaced from each other. Each of the locking units 11 includes a plurality of locking blocks 12. Preferably, each of the locking units 11 includes four locking blocks 12 which are spaced from each other and arranged to have a substantially cross-shaped profile. Each of the locking blocks 12 of each of the locking units 11 is in line with an axial direction of the respective upright post 10 and is perpendicular to an axial direction of the respective transverse post 20.

Each of the locking blocks 12 of each of the locking units 11 is provided with two locking holes 14 and a receiving recess 13 located between the two locking holes 14. Each of the two locking holes 14 of each of the locking blocks 12 has a substantially trapezoid profile, and the two locking holes 14 of each of the locking blocks 12 are arranged symmetrically about the receiving recess 13. Each of the locking blocks 12 of each of the locking units 11 is further provided with two fixing holes 15, wherein the two locking holes 14 are located between the two fixing holes 15. Each of the two fixing holes 15 of each of the locking blocks 12 has a substantially oblique oblong profile, and the two fixing holes 15 of each of the locking blocks 12 are arranged symmetrically about the receiving recess 13.

Each of the transverse posts 20 has two opposite ends each provided with an insertion head 21 inserted into the receiving recess 13 of a respective one of the locking blocks 12 of the respective locking unit 11. The insertion head 21 of each of the transverse posts 20 is rotatable in the receiving recess 13 of the respective locking block 12 of the respective locking unit 11 and is provided with two opposite snapping portions 22 each detachably snapped into a respective one of the two locking holes 14 of the respective locking block 12 of the respective locking unit 11 to combine the insertion head 21 of each of the transverse posts 20 with the respective locking block 12 of the respective locking unit 11.

The two snapping portions 22 of the insertion head 21 of each of the transverse posts 20 are located at two opposite sides of the respective locking block 12 of the respective locking unit 11 and are movable toward two opposite directions when the insertion head 21 of each of the transverse posts 20 is rotatable in the receiving recess 13 of the respective locking block 12 of the respective locking unit 11. Each of the two snapping portions 22 of the insertion head 21 of each of the transverse posts 20 has a substantially trapezoid profile and has size smaller than that of the respective locking hole 14 of the respective locking block 12 of the respective locking unit 11. Each of the two snapping portions 22 of the insertion head 21 of each of the transverse posts 20 has a side provided with a receiving space 23 connected to the respective locking hole 14 and the receiving recess 13 of the respective locking block 12 of the respective locking unit 11 to receive a bottom wall 140 of the respective locking hole 14 of the respective locking block 12 of the respective locking unit 11 when each of the two snapping portions 22 of the insertion head 21 of each of the transverse posts 20 is snapped into the respective locking hole 14 of the respective locking block 12 of the respective locking unit 11 so as to allow rotation of the insertion head 21 of each of the transverse posts 20 in the receiving recess 13 of the respective locking block 12 of the respective locking unit 11.

The scaffold further comprises a plurality of oblique posts 30 each detachably mounted between the locking units 11 of any two adjacent upright posts 10, and a plurality of fasteners 40 each mounted between a respective one of the upright posts 10, a respective one of the locking units 11 and a respective one of the oblique posts 30 to combine the upright posts 10, the locking units 11 and the oblique posts 30 together.

Each of the oblique posts 30 has two opposite ends each provided with a reduced mounting head 31 which abuts a respective one of the locking blocks 12 of the respective locking unit 11 and is provided with a mounting hole 32 which has a substantially oblong profile.

Each of the fasteners 40 has a substantially U-shaped profile and has a first end provided with a snapping section 41 extending through the mounting hole 32 of the mounting head 31 of a respective one of the oblique posts 30 and snapped into a respective one of the two fixing holes 15 of the respective locking block 12 of the respective locking unit 11 to combine the respective oblique post 30 and the respective locking unit 11 together. Each of the fasteners 40 has a second end provided with an abutting section 42 abutting a peripheral wall of a respective one of the upright posts 10. The snapping section 41 of each of the fasteners 40 has a substantially arc-shaped profile. The abutting section 42 of each of the fasteners 40 has a substantially arc-shaped profile and is directed toward a direction perpendicular to that of the snapping section 41.

Figure 1:
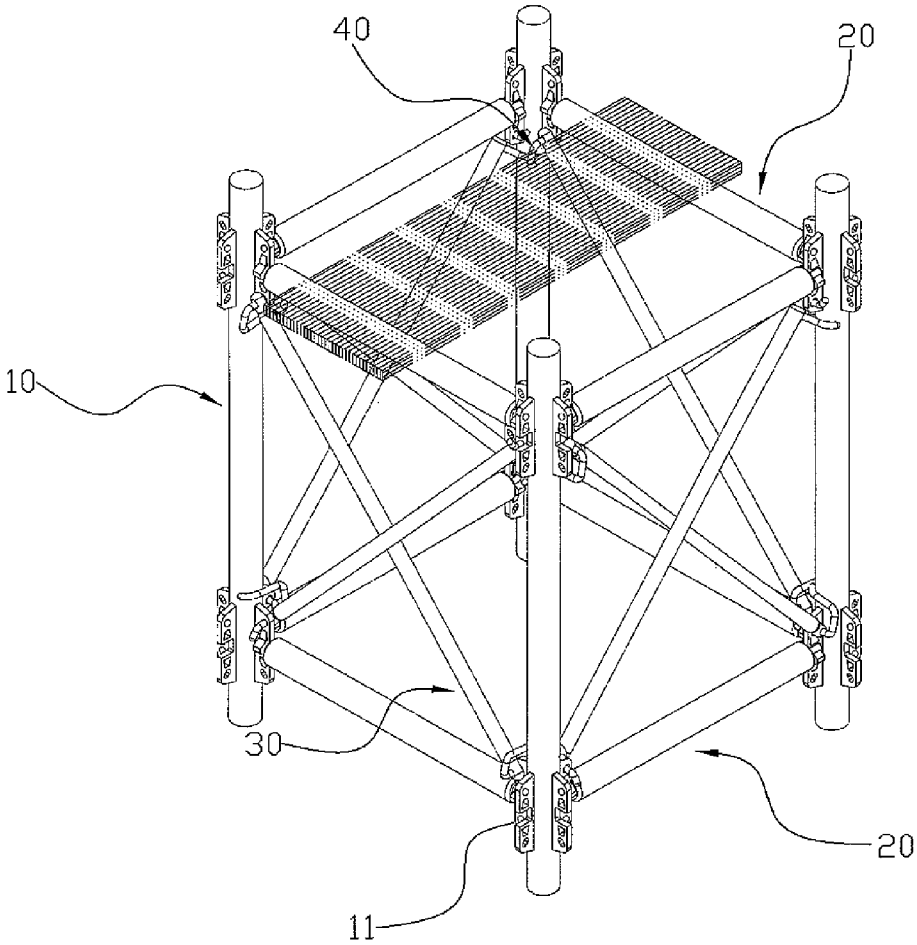
FIG. 1 is a perspective view of a scaffold in accordance with the preferred embodiment of the present invention.
Figure 2:
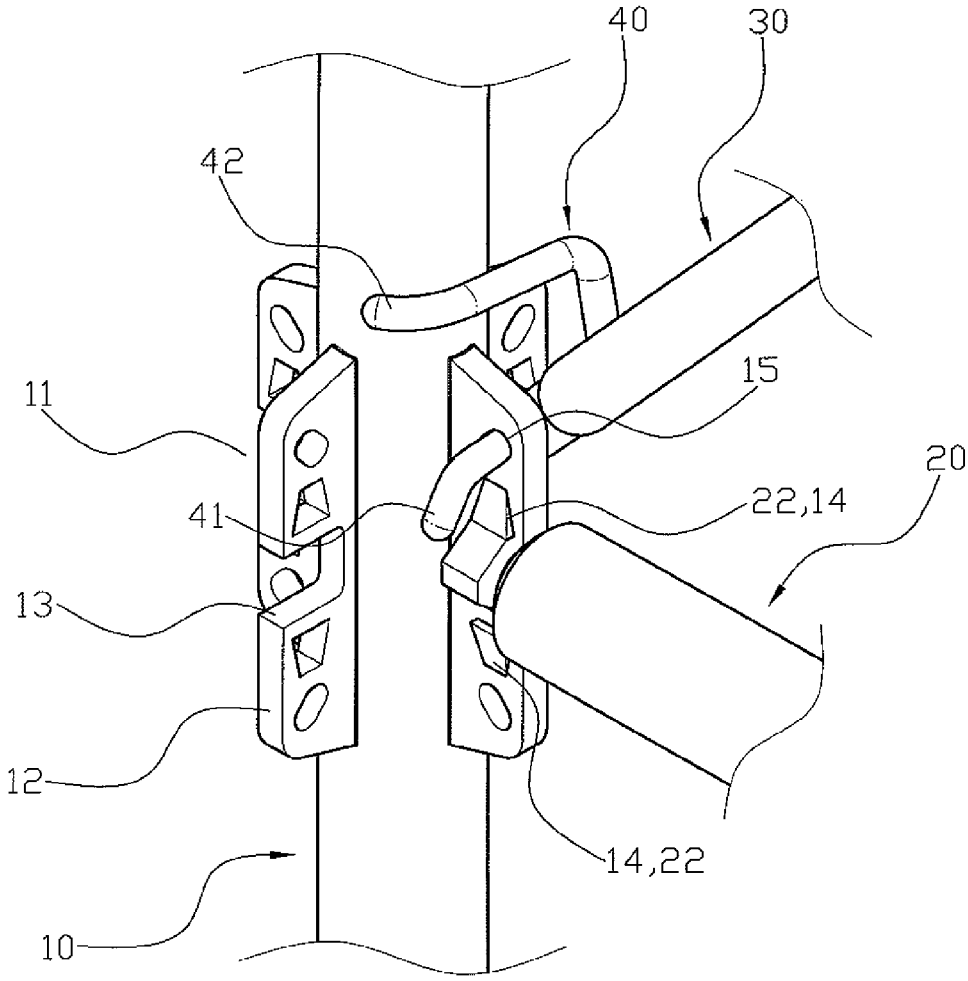
FIG. 2 is a locally enlarged perspective view of the scaffold as shown in FIG. 1.
Figure 4:
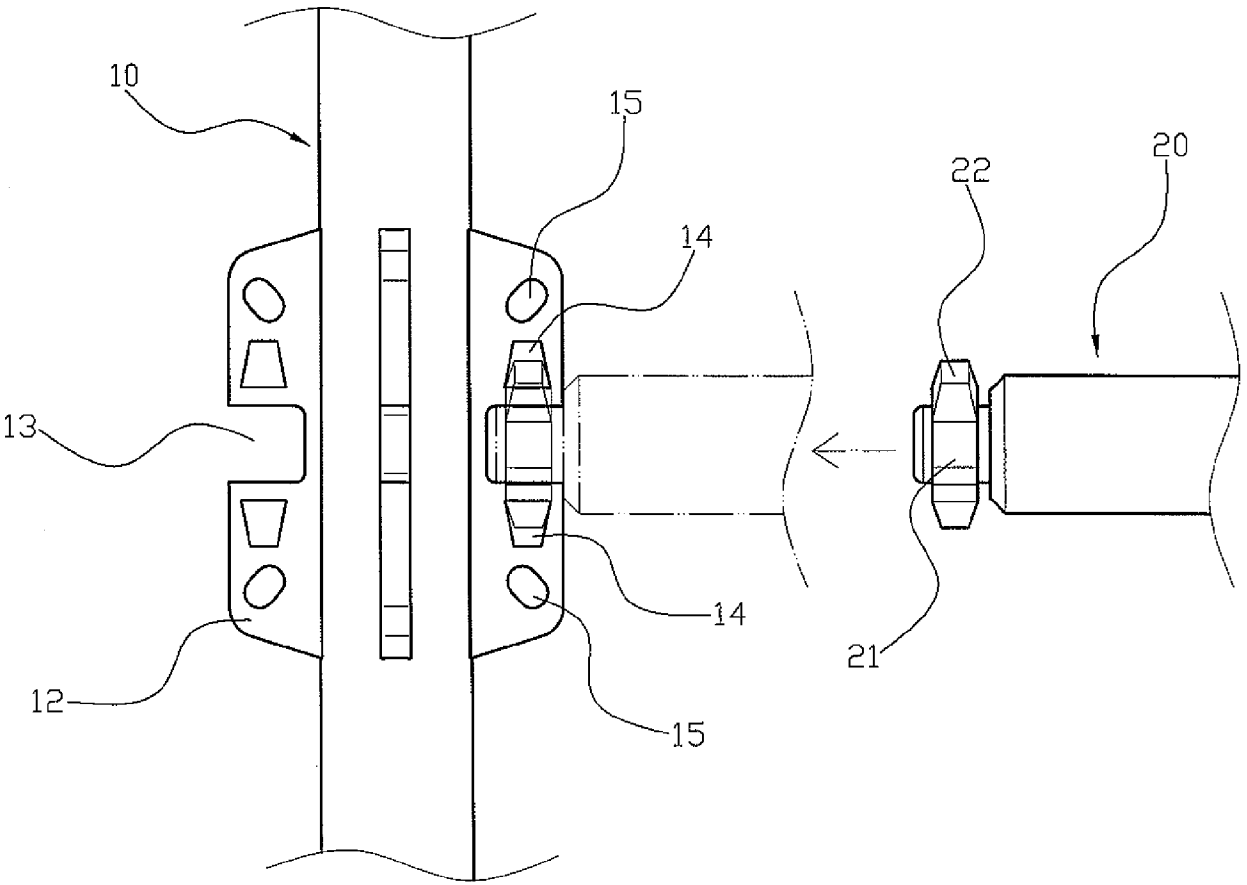

In assembly, after the insertion head 21 of each of the transverse posts 20 is inserted into the receiving recess 13 of the respective locking block 12 of the respective locking unit 11 as shown in FIG. 4, the insertion head 21 of each of the transverse posts 20 is rotatable in the receiving recess 13 of the respective locking block 12 of the respective locking unit 11 as shown in FIG. 5, so that each of the two snapping portions 22 of the insertion head 21 of each of the transverse posts 20 is snapped into the respective locking hole 14 of the respective locking block 12 of the respective locking unit 11 as shown in FIG. 2 to combine the insertion head 21 of each of the transverse posts 20 with the respective locking block 12 of the respective locking unit 11. In such a manner, the upright posts 10 and the transverse posts 20 are combined together by the locking units 11. Subsequently, the mounting head 31 of each of the oblique posts 30 abuts a respective one of the locking blocks 12 of the respective locking unit 11. Then, the snapping section 41 of each of the fasteners 40 extends through the mounting hole 32 of the mounting head 31 of a respective one of the oblique posts 30 and is snapped into a respective one of the two fixing holes 15 of the respective locking block 12 of the respective locking unit 11 as shown in FIG. 6 to combine the respective oblique post 30 and the respective locking unit 11 together. Finally, each of the fasteners 40 is pivotable relative to the mounting head 31 of the respective oblique post 30 until the abutting section 42 of each of the fasteners 40 abuts the peripheral wall of the respective upright post 10 as shown in FIG. 7. In such a manner, the upright posts 10, the locking units 11 and the oblique posts 30 are combined together by the fasteners 40. Thus, the upright posts 10, the transverse posts 20 and the oblique posts 30 are combined together to form the scaffold as shown in FIG. 1.

Referring to FIG. 8, each of the oblique posts 30 has a first end secured to a respective one of the transverse posts 20 and a second end detachably mounted on a respective one of the locking units 11. The second end of each of the oblique posts 30 is provided with the reduced mounting head 31.

Accordingly, the upright posts 10, the locking units 11, the transverse posts 20, the oblique posts 30 and the fasteners 40 are detachable from each other so that the scaffold is detachable before assembly, thereby facilitating packaging, storage and transportation of the scaffold. In addition, the upright posts 10, the locking units 11, the transverse posts 20, the oblique posts 30 and the fasteners 40 are combined together by a worker himself so that the scaffold is assembled easily and quickly without needing aid of any hand tool, thereby greatly facilitating the worker mounting the scaffold. Further, the scaffold is assembled without needing aid of any hand tool, so that the worker needs not to place hand tools on the scaffold and needs not to worry about possibility of falling of the hand tools, thereby protecting the worker's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A scaffold, comprising:

a plurality of upright posts each provided with a plurality of locking units;

a plurality of transverse posts mounted between the upright posts and each detachably locked onto a respective one of the locking units; wherein:

each of the locking units includes a plurality of locking blocks;

each of the locking blocks of each of the locking units is provided with two locking holes and a receiving recess located between the two locking holes;

each of the transverse posts has two opposite ends each provided with an insertion head inserted into the receiving recess of a respective one of the locking blocks of the respective locking unit;

the insertion head of each of the transverse posts is provided with two opposite snapping portions each detachably snapped into a respective one of the two locking holes of the respective locking block of the respective locking unit to combine the insertion head of each of the transverse posts with the respective locking block of the respective locking units;

each of the two snapping portions of the insertion head of each of the transverse posts has a side provided with a receiving space connected to the respective locking hole and the receiving recess of the respective locking block of the respective locking unit to receive a bottom wall of the respective locking hole of the respective locking block of the respective locking unit when each of the two snapping portions of the insertion head of each of the transverse posts is snapped into the respective locking hole of the respective locking block of the respective locking unit so as to allow rotation of the insertion head of each of the transverse posts in the receiving recess of the respective locking block of the respective locking unit;

the scaffold further comprises:

a plurality of oblique posts each detachably mounted between the locking units of any two adjacent upright posts;

a plurality of fasteners each mounted between and contacting with a respective one of the upright posts, a respective one of the locking units and a respective one of the oblique posts to combine the upright posts, the locking units and the oblique posts together;

each of the locking blocks of each of the locking units is provided with two fixing holes;

each of the oblique posts has two opposite ends each provided with a reduced mounting head which abuts a respective one of the locking blocks of the respective locking unit and is provided with a mounting hole;

each of the fasteners has a first end provided with a snapping section extending through the mounting hole of the mounting head of a respective one of the oblique posts and snapped into a respective one of the two fixing holes of the respective locking block of the respective locking unit to combine the respective oblique post and the respective locking unit together;

each of the fasteners has a second end provided with an abutting section abutting a peripheral wall of a respective one of the upright posts.

2. The scaffold in accordance with claim 1, wherein each of the locking units includes four locking blocks which are spaced from each other and arranged to have a substantially cross-shaped profile.

3. The scaffold in accordance with claim 1, wherein the two locking holes of each of the locking blocks are arranged symmetrically about the receiving recess;

each of the two locking holes of each of the locking blocks is spaced from and not connected to the receiving recess.

4. The scaffold in accordance with claim 3, wherein each of the two snapping portions of the insertion head of each of the transverse posts has size smaller than that of the respective locking hole of the respective locking block of the respective locking unit.

5. The scaffold in accordance with claim 1, wherein each of the two fixing holes of each of the locking blocks has a substantially oblique oblong profile;

the two fixing holes of each of the locking blocks are arranged symmetrically about the receiving recess;

each of the two fixing holes of each of the locking blocks is spaced from and not connected to the receiving recess.

6. The scaffold in accordance with claim 1, wherein each of the locking blocks of each of the locking units is a flat sheet plate which is disposed at a vertical state;

the two locking holes of each of the locking blocks are located between the two fixing holes;

each of the two locking holes of each of the locking blocks is located between the receiving recess and a respective one of the two fixing holes.

7. The scaffold in accordance with claim 1, wherein the insertion head of each of the transverse posts is rotatable in the receiving recess of the respective locking block of the respective locking unit to insert each of the two snapping portions of the insertion head of each of the transverse posts into the respective locking hole of the respective locking block of the respective locking unit.

8. The scaffold in accordance with claim 7, wherein the two snapping portions of the insertion head of each of the transverse posts are located at two opposite sides of the respective locking block of the respective locking unit and are movable toward two opposite and parallel directions when the insertion head of each of the transverse posts is rotatable in the receiving recess of the respective locking block of the respective locking unit.

9. The scaffold in accordance with claim 1, wherein each of the fasteners has a substantially U-shaped profile.

10. The scaffold in accordance with claim 1, wherein the snapping section of each of the fasteners is perpendicular to the first end of each of the fasteners and has a substantially arc-shaped profile.

11. The scaffold in accordance with claim 1, wherein the abutting section of each of the fasteners is perpendicular to the second end of each of the fasteners and has a substantially arc-shaped profile.

12. The scaffold in accordance with claim 1, wherein the abutting section of each of the fasteners is directed toward a direction perpendicular to that of the snapping section.

13. The scaffold in accordance with claim 1, wherein each of the fasteners is pivotable relative to the mounting head of the respective oblique post until the abutting section of each of the fasteners abuts the peripheral wall of the respective upright post.

14. The scaffold in accordance with claim 1, wherein the locking units on each of the upright posts are spaced from each other.

15. The scaffold in accordance with claim 1, wherein each of the locking blocks of each of the locking units is in line with an axial direction of the respective upright post and is perpendicular to an axial direction of the respective transverse post.

* * * * *